US006779679B1

(12) United States Patent
Dias, Jr. et al.

(10) Patent No.: US 6,779,679 B1
(45) Date of Patent: Aug. 24, 2004

(54) INSULATED CONTAINER FOR A BEVERAGE BAG

(75) Inventors: Richard J. Dias, Jr., North Huntingdon, PA (US); Alex Yuan-Fu Huang, Schaumburg, IL (US)

(73) Assignee: Thermos L.L.C., Rolling Meadows, IL (US)

( * ) Notice: Subject to any disclaimer, the term of this patent is extended or adjusted under 35 U.S.C. 154(b) by 0 days.

(21) Appl. No.: 10/429,308

(22) Filed: May 5, 2003

(51) Int. Cl.[7] ..... A47G 19/22
(52) U.S. Cl. ..... 220/709; 229/103.1
(58) Field of Search ..... 220/705, 707, 220/709; 229/103.1; 206/222

(56) References Cited

U.S. PATENT DOCUMENTS 4,669,124 A * 5/1987 Kimura ..... 383/80
4,801,007 A * 1/1989 Rule ..... 206/217
D327,848 S * 7/1992 Hanover ..... D9/436
5,201,459 A * 4/1993 Bettle et al. ..... 229/103.1
5,515,762 A * 5/1996 Perkins et al. ..... 84/315

* cited by examiner

*Primary Examiner*—Joseph Man-Fu Moy
(74) *Attorney, Agent, or Firm*—Wood, Phillips, Katz, Clark & Mortimer

(57) ABSTRACT

A desired serving temperature of a beverage contained in a flexible beverage bag for soft-sided container (20) is maintained for a prolonged period without undesirable leakage in a structure that includes an insulating container having a bottom wall (10), an upstanding, insulated side wall (12) defining a beverage bag receiving space (18) and having an upper opening (14) together with a closure (16) arranged for movement between positions opening and closing the upper opening (14). A rigid straw (42) is mounted on the container and has opposed ends (44,46) with one of the ends (44) having a sharp, lance-like tip located within the beverage bag receiving space (18) and the other end (46) extending away from the insulating container. A straw-like mouthpiece (50) is disposed on the other end (46) and a seal (68) is disposed about the end (44) that seals against the rigid straw (42) as well as the beverage bag (20) when the end (44) is pierced and enters the beverage bag (20).

23 Claims, 3 Drawing Sheets

INSULATED CONTAINER FOR A BEVERAGE BAG

FIELD OF THE INVENTION

This invention relates to insulated beverage containers, and more particularly, to an insulated container for use with a beverage bag.

BACKGROUND OF THE INVENTION

Containers for single portion of beverages such as juices, are seeing increased popularity. In the usual case, a soft-sided container, such as a blow molded plastic bag, a packed paper container or a pouch made from a heat sealed thin pliable sheet forms the beverage bag and typically will have a capacity on the order of 6–8 ounces. A straw, sometimes provided with a lance-like sharp end, is provided and caused to pierce the beverage bag to achieve access to its contents. The user sucks the contents from the bag via the straw.

While these types of containers work well for their intended purpose, they are not without certain drawbacks. For example, due to the soft-sided nature of the containers and their relative pliability, if they are squeezed too hard during use, the beverage may leak from the opening formed by the straw resulting in a messy condition. And even when the beverage bag is made with semi-rigid walls, i.e., a lined paper container, where the contents are consumed over a period of time, there may be considerable heat exchange with the ambient, resulting in the beverage being too warm or too cold, depending on whether the beverage is to be consumed in a chilled state or a heated state.

The present invention is directed to providing a means whereby these difficulties may be overcome.

SUMMARY OF THE INVENTION

It is a principal object of the invention to provide a container for use with beverage bags. More specifically, one object of the invention is to provide a container that is insulated to as to minimize heat exchange between the beverage and the ambient, allowing the beverage to retain its initial serving temperature for an extended period. It is also an object of the invention to provide a container for use with beverage bags that permits ready piercing of the beverage bag with a sharp, lance-like end of a straw and which minimizes or eliminates undesirable leakage of the beverage from the beverage bag after the same has been pierced by the straw.

An exemplary embodiment achieves the foregoing objects in a structure that includes an insulated container having a bottom wall, an upstanding insulated side wall defining a beverage bag receiving space having an upper opening, and a closure movable between positions opening and closing the upper opening. A rigid straw is mounted on the insulated container and has opposed ends with one of the ends having a sharp, lance-like tip located within the beverage bag receiving space in spaced relation to the container walls for piercing and entering a beverage bag located within the beverage bag receiving space. The other end of the rigid straw extends away from the insulated container. A straw-like mouthpiece is disposed on the end of the straw that extends away from the container and a seal is disposed about the lance-like end for sealing engagement with both the lance-like end and a beverage bag located within the beverage receiving space.

In one embodiment, the rigid straw is mounted on the closure.

A preferred embodiment contemplates that the closure include first and second cup-like structures opening towards each other with the second cup-like structure being movably and telescopically received within the first cup-like structure. Cooperating retention elements on the side wall near the upper opening and on the first cup-like structure removably retain the closure with the first cup-like structure in and closing the upper opening. A sleeve is in and extends through the first cup-like structure slidably receiving the rigid straw lance-like end and the rigid straw end that extends away from the closure extends through and is attached to the second cup-like structure.

A preferred embodiment contemplates that there be a compression coil spring located between the cup-like structures and preferably, the seal is a ring located on the first cup-like structure to surround and seal against the rigid straw lance-like end when the rigid straw lance-like end extends from the sleeve into the beverage bag receiving space. Preferably, such a seal is an O-ring.

The invention also contemplates the provision of a seal carried by the first cup-like structure about its periphery that is in sealing engagement with an interior part of the side wall when the closure closes the upper opening.

In one embodiment, the side wall and bottom wall are integral with one another and even more preferably, both include inner and outer walls defining an insulating space.

In another embodiment of the invention, the rigid straw is in two sections, one carried by the side wall and/or the bottom wall and the other carried by the closure. The sections have aligned openings in fluid communication with each other when the closure is in a position closing the upper opening.

This embodiment of the invention, in a preferred form thereof, contemplates the provision of a gasket carried by the insulated container and located at the aligned openings of the two straw sections.

One embodiment of the invention contemplates that the closure be connected to the side wall adjacent the upper opening by a pivotal connection. In one embodiment, a closure lock is provided opposite the pivotal connection for locking the closure in a closed position.

The invention also contemplates the provision of a seal carrier in one embodiment that is slidably received on the lance-like end of the straw and which carries a seal on a side of the carrier together with a biasing spring bearing against the seal carrier oppositely of the seal.

In such an embodiment, it is contemplated that the lance-like end extends into the beverage bag receiving space from the bottom wall and the spring is interposed between the seal carrier and the bottom wall.

In still another embodiment of the invention, the bottom, the side wall and the closure are separable from one another.

It is also contemplated that both the bottom and closure be plug-like and carry respective seals, each engaging an adjacent part of the side wall.

The various embodiments of the invention, in a preferred form also contemplate the use of a removable cap for the mouthpiece.

Other objects and advantages will become apparent from the following specification taken in connection with the accompanying drawings.

DESCRIPTION OF THE PREFERRED EMBODIMENTS

Exemplary embodiments of the invention will be described herein with reference to the accompanying drawings in connection with a beverage bag of a blow molded type. However, it is to be understood that the invention can be employed with efficacy with other types of beverage bags such as soft walled paper containers provided with appropriate liners, pouches made from heat sealed thin sheet material or other thin walled plastic containers of various sorts. No limitation to any particular type of beverage bag is intended except insofar as set forth in the appended claims.

Figure 3:
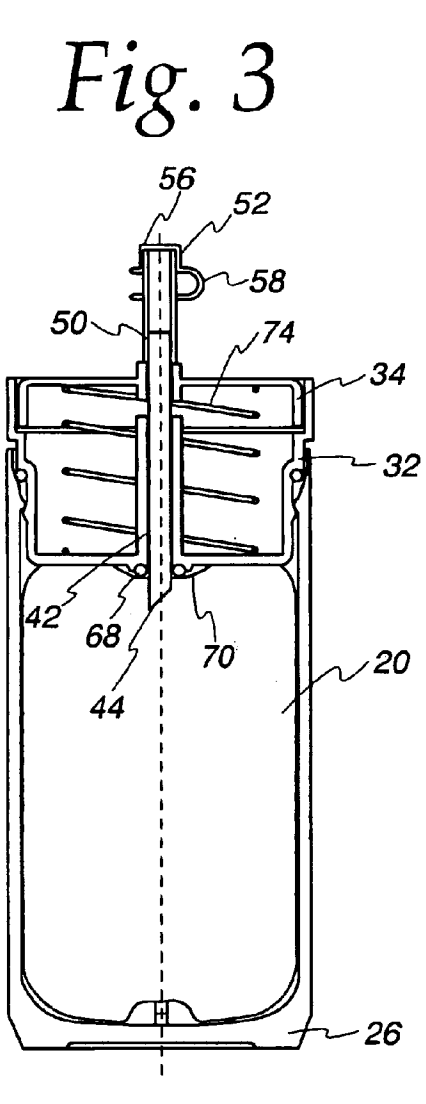
FIG. 3 is a view similar to FIGS. 1 and 2 but illustrating the components as they would appear when the container includes a beverage bag which has been pierced by a straw.
Figure 2:
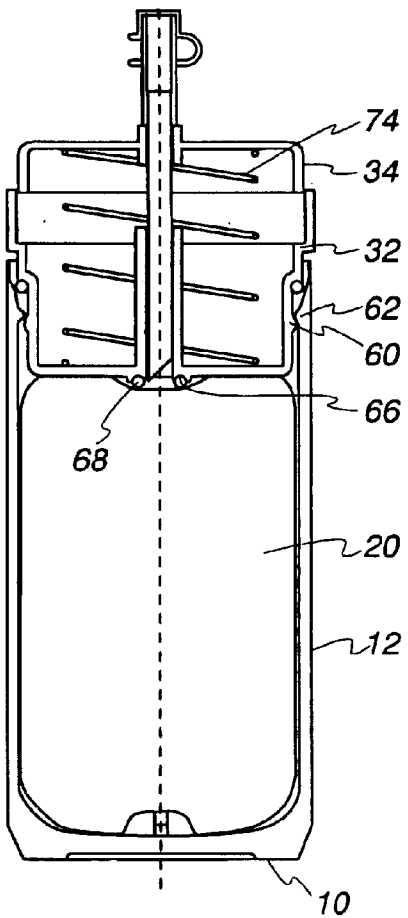
FIG. 2 is a view similar to FIG. 1 but showing the components in their assembled condition.
Figure 1:
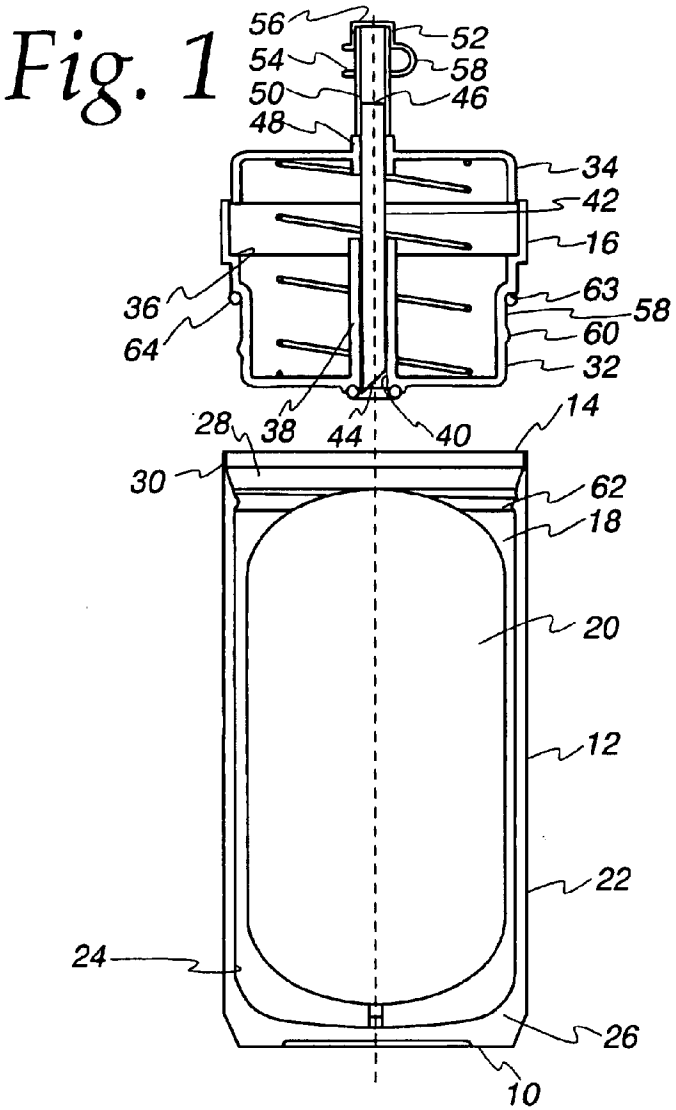
FIG. 1 is a vertical section of one embodiment of an insulated container for a beverage bag made according to the invention and shown in a partial exploded condition.

Referring to FIGS. 1–3, a first embodiment of the insulated container is illustrated and is seen to include a bottom 10, an upstanding side wall 12 with an upper opening 14 and a closure 16 for the opening 14. The bottom 10 and the side wall 12 define a beverage bag receiving space 18 in which is located a blow molded beverage bag 20 that is filled with a beverage (not shown).

In a typical case, the base 10 will be circular and the side wall 12 cylindrical but other forms may be used depending upon the configuration and pliability of the beverage bag 20.

In the embodiment illustrated in FIGS. 1–3, the bottom 10 and side wall 12 are integral with each other, that is, of unitary construction. Preferably, the bottom 10 and the side wall 12 include an outer shell 22 in which an inner shell 24 is received in spaced relation so as to define an insulating space 26. The insulating space 26 may be filled with an insulating material such as a foam, if desired, but more usually will have a vacuum drawn therein. To maintain the vacuum, an upper lip 28 on the inner liner 24 will be secured and hermetically sealed to the upper lip of the outer liner 22.

In the usual case, the outer and inner shells 22 and 24 will be formed of metal such as brushed stainless steel when a vacuum is drawn on the insulating space 26. However, other materials may be used, particularly when the insulating space is filled with an insulator such as dead air or foam.

The closure 16 is formed of first and second cup-shaped elements 32 and 34, respectively, which face each other. The second cup-like element 34 faces the opening of the first cup-like element 32 and may be telescopically received in the latter as illustrated, for example, in FIG. 3.

To limit movement of the second cup-like element 34 into the first cup-like element 32, the latter includes a peripheral shoulder 36 against which the second cup-like element 34 may abut when telescoped into the first cup-like element 32.

The first cup-like element carries an elongated sleeve 38 which has an opening 40 located generally on the center line of the side wall 12 in which a straw 42 is slidably received. The straw 42 is made of a relatively rigid material such as hard plastic and has opposed ends 44 and 46. The end 44 is preferably cut diagonally on the rigid straw 42 so as to form a lance-like tip for penetrating the beverage bag 20 and to that end, the end 44 faces the bag 20. The second cup-like element 34 also includes a centered, relatively short sleeve 48 that receives the straw 42. However, in the case of the sleeve 48, the same is fastened to the straw 42 so that the straw 42 moves with the second cup-like element 34 when the same is telescoped into or out of the first cup-like element 32. A relatively soft straw-like mouthpiece 50 formed of a paper straw or the like is provided to tightly but removably fit on the end 46 of the rigid straw 42 to serve as a disposable mouthpiece which is introduced into the mouth of the user of the insulated container when extracting beverage from the contents of the beverage bag 20. Desirably, a removable cap 52 may be fitted to the end of the mouthpiece 50 remote from the end 46 of the straw 42. It may include a ring-like configuration 54 that fits about the mouthpiece 50 which is connected to a closure cap 56 for covering the upper end of the mouthpiece 50 and connected to the ring-like configuration 54 by a flexible plastic strap 58.

Returning to the first cup-like element 32, the same includes a base section 58 of a size to fit within the upper opening 14 at the top of the side wall 12. The base-like portion includes a peripheral thread 60 which may be threaded to an internal thread 62 on the inner liner 24 of the side wall 12. The base-like section 58 may be separated from the remainder of the first cup-like element by an external ledge 63 which carries an O-ring seal 64 which seals against the inner liner 12 at the access opening 14 when the closure 16 is in place as illustrated in FIGS. 2 and 3.

In addition, a peripheral groove 66 may be formed in the first cup-like element 32 about the opening 40 to receive an O-ring seal 68 which is positioned to sealingly engage the rigid straw 42, the first cup-like element 32, and an area 70 of the upper surface of the beverage bag 20 as seen in FIGS. 2 and 3.

Finally, a compression coil spring 74 is located within the closure 16 to bias the first and second cup-like elements 32,34 to the position illustrated in FIGS. 1 and 2. Any suitable stop may be employed to prevent the spring 74 when pushing the cup-like elements 32,34 completely apart to a point where they can become disassociated or alternatively, the spring 74, and the length thereof, may be chosen or the spring will never move the second cup-like element 34 relative to the first cup-like element 32 as the point illustrated. In the case of the latter, the two may disassociated for cleaning when desired.

In use, the beverage bag is introduced into the beverage bag receiving space 18 as illustrated in FIG. 1. The closure 16 may then be threaded in place to cause the beverage bag 20 to basically conform to the interior shape of the beverage bag receiving space 18 as illustrated in FIG. 2. The second cup-like element 34 may then be depressed against the bias of the spring 74 as illustrated in FIG. 3 such that the lance-shaped end 44 punctures and enters the beverage bag 20. If desired, a relatively weak detent (not shown) may be located between the first sleeve-like element 32 and the second sleeve-like element 34 to lightly hold the same in the position illustrated in FIG. 3. Preferably, the cap 52 will remain in the configuration illustrated in FIGS. 1–3 during this process so that there will be no spurt of any part of the contents of the beverage bag 20 through the straw 42 and the mouthpiece 50 at this time.

After the beverage bag 20 has been punctured, the cap 56 may be lifted off of the mouthpiece 50 and pivoted away from the same on the strap 58 to allow the user to place his/her lips on the mouthpiece 50 and withdraw the contents of the beverage bag 20.

It will be appreciated that by reason of the presence of the insulating space 26, the beverage bag 20 and the contents thereof will be maintained generally at the temperature of the beverage bag 20 when it was introduced into the beverage bag receiving space 18 for an extended period to prevent the contents from being warmed or cooled by the ambient. At the same time, it will further be appreciated that leakage is precluded by the presence of the seals 64,68 and by the cap 56 during the piercing process.

Figure 5:
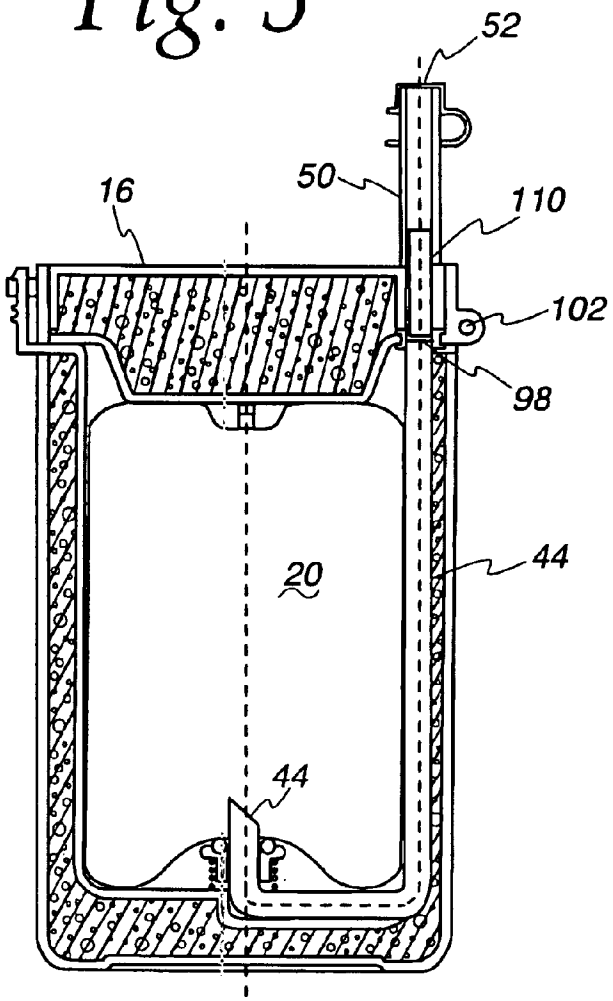
FIG. 5 is a view similar to FIG. 4 but illustrating the components with the closure in a closed position.
Figure 4:
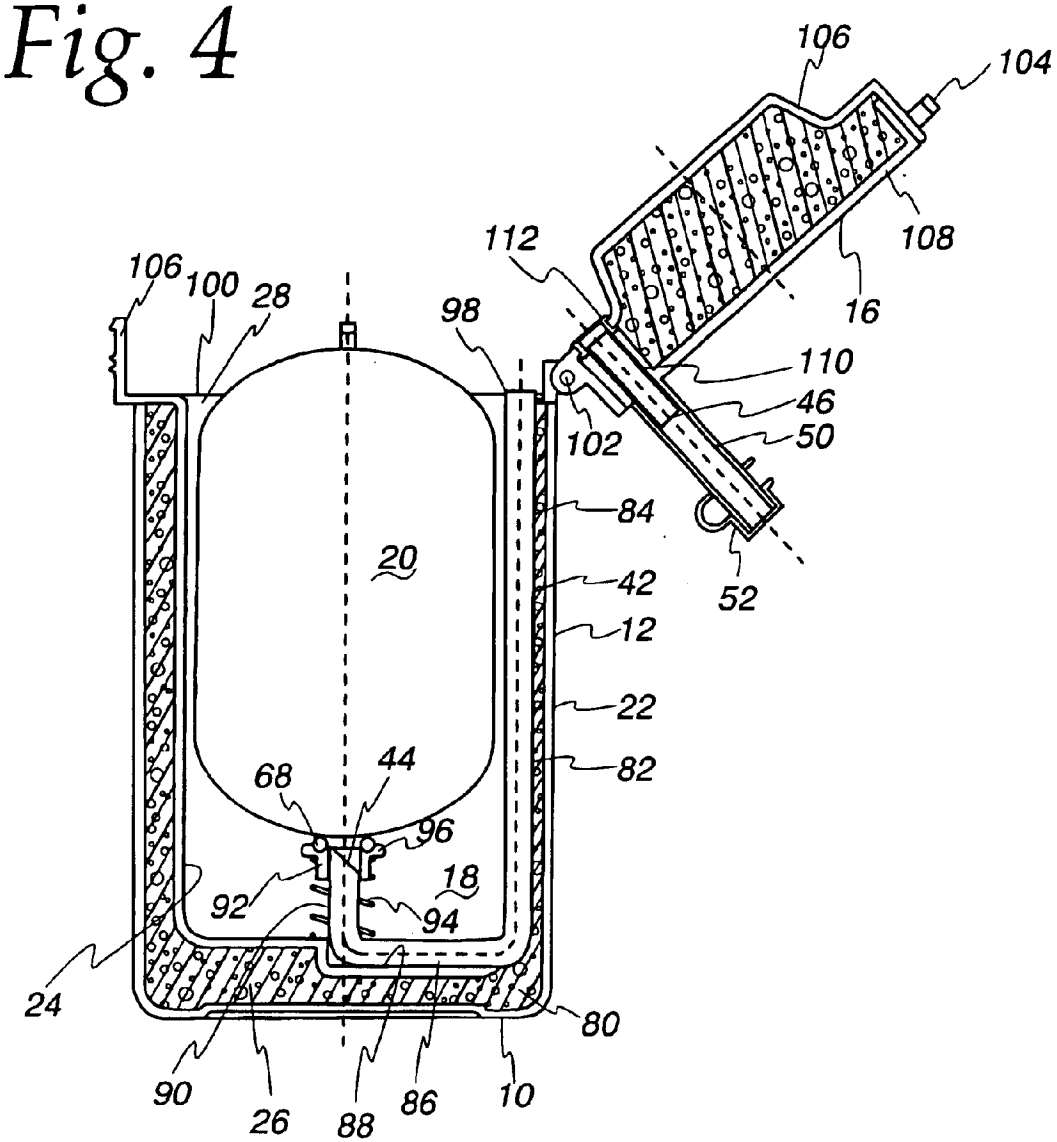
FIG. 4 is a vertical section of a modified embodiment of the invention with the closure therefor opened.

A second embodiment is illustrated in FIGS. 4 and 5 and where like components are utilized, like reference numerals will be employed and will not be redescribed in the interest of brevity.

In the embodiment of FIGS. 4 and 5, side wall 12 again may be cylindrical and bottom 10 circular. And again, both include an outer liner 22 and an inner line 24 and define a beverage bag receiving space 18. In this embodiment, foam insulation 80 fills the insulating space 26.

The rigid straw 42 includes a first L-shaped section 82 having an upright part 84 received in a groove or molded into the side wall 12. The upright part 84 extends to a horizontal or base section 86 which is located in a groove-like section 88 of the inner liner 24 at the bottom 10. The base section 86 in turn terminates with a centrally located reentrant vertically extending section 90 having the lance-like end 44 thereon. A seal carrier 92 is slidably mounted on the end 44 and carries the O-ring seal 68 for engagement with the beverage bag 20. A compression coil spring 94 is interposed between the interior of the bottom 10 and an upper flange 96 of the seal carrier 92 to bias the seal carrier 92 against the beverage bag so that the seal 68 will seal against the beverage bag 20 and the reentrant section 90 of the straw 42 to prevent leakage. If desired, a suitable detent (not shown) may be located at the interface of the seal carrier 92 and the reentrant portion 90 so as to prevent the former from becoming disassociated with the latter.

Returning the upright section of the rigid straw 42, the same has an upper end 98 that terminates just above an edge 100 the inner liner 24 which defines the upper opening 28. The closure 16 is pivoted by a pivot pin 102 at one side of the upper end of the side wall 12, and specifically, the outer liner 22. Thus, the closure 16 is movable between an open position as shown in FIG. 4 at a position closing the upper opening 28 as shown in FIG. 5.

Oppositely of the pivot 102, the closure 16 includes a finger 104 which may latch on a notched spring finger 106 and may be formed of an integral part of the inner liner 24 at its upper edge 100 as illustrated in FIG. 4. As an alternative, it could be formed as an extension of the outer liner 22 if desired.

The closure 16 is formed of two complementary shells 106 and 108, the former being configured to enter the beverage bag receiving space 18 to urge the bag 20 downwardly against the lanced end 44 of the rigid straw 42 for piercing purposes as seen in FIG. 5. In addition, adjacent the pivot, the closure 16 carries a continuation section 110 of the rigid straw 42 and which includes the mouthpiece receiving end 46. The mouthpiece 50 and cap 52 are disposed thereon.

The section 110 is secured to the closure 16 for movement therewith and partially enters a circular grommet 112 which also fits over the upper end 98 of the upright section 84 of the rigid straw 42 as illustrated in FIG. 5 to seal the two sections of the rigid straw 44 together when the closure is closed.

Use is generally the same as described in connection with the embodiment of FIGS. 1–3, namely, that after the beverage bag 20 has been placed in the beverage bag receiving space 18, movement of the closure 16 to the closed position causes the beverage bag 20 to be pierced by the lance-like end 44 of the rigid straw 42. This same movement establishes fluid communication all the way to the mouthpiece 50 so that when the cap 52 is opened, the user may place his/her lips on the mouthpiece 50 to withdraw the contents of the beverage bag 20 therefrom.

Figure 8:
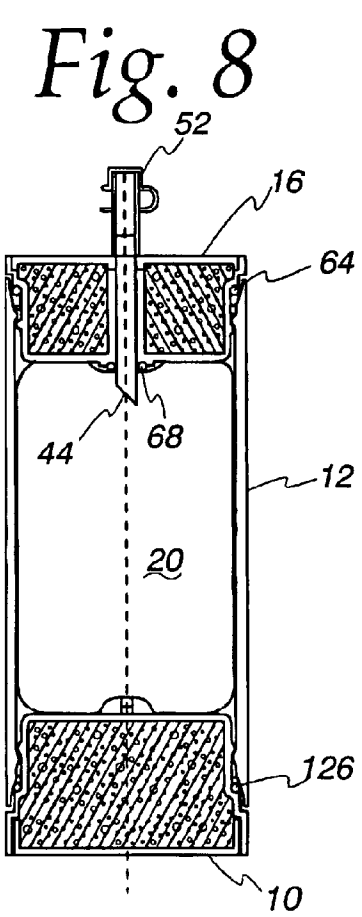
FIG. 8 shows the components of the third embodiment in a fully assembled condition.
Figure 7:
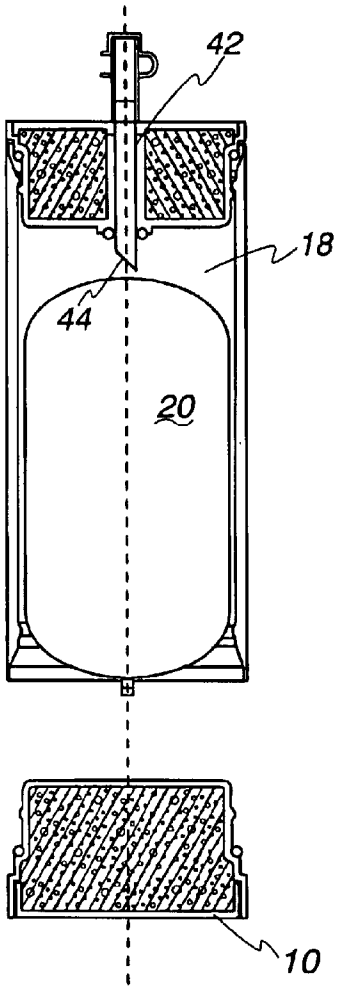
FIG. 7 illustrates the components of the third embodiment in a partially assembled condition.
Figure 6:
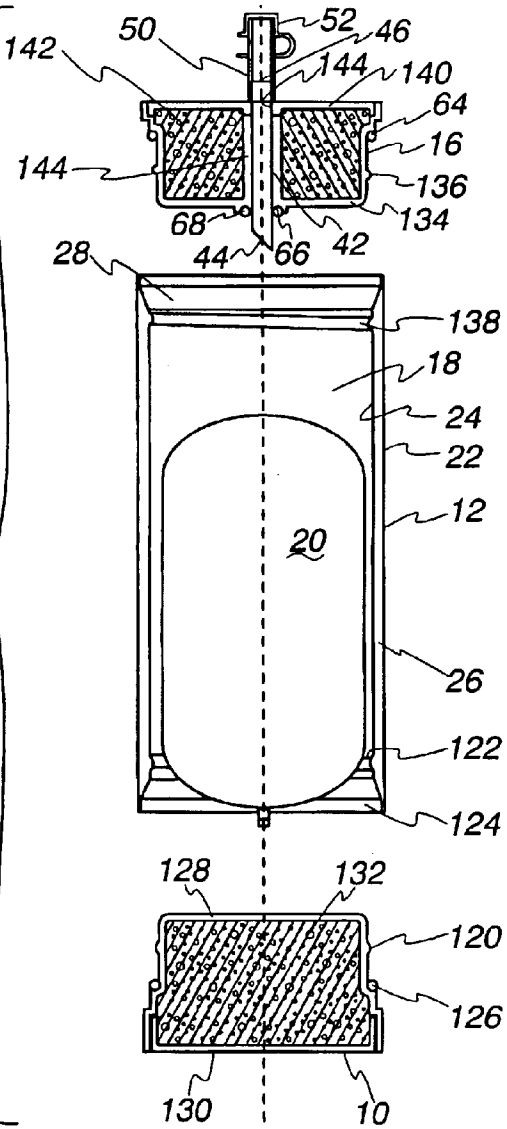
FIG. 6 is an exploded, vertical section of a third embodiment of the invention.

A third embodiment is illustrated in FIGS. 6–8, inclusive and again, where like components are involved, like reference numerals will be utilized and generally will not be redescribed. In this embodiment, side wall 12 is again provided with an outer liner 22 and an inner liner 24 which are joined at their upper and lower ends to define an insulating space 26 as well as a beverage bag receiving space 18 in which the beverage bag 20 may be received. The bottom 10 is formed as an element that is separate from the side wall 12 and appears somewhat stopper like. It includes an external thread 120 that mates with an internal thread 122 on the inner liner 24 near a bottom opening 124 in the side wall 12. An O-ring seal 126 is carried by the bottom 10 and the same is formed of two cup-like elements 128,130 that define an insulation receiving volume 132.

The closure 16 includes a base section 134 carrying a thread 136 which may mate with the thread 138 near the upper opening 28 of the side wall 12. The base section 134 also carries the O-ring seal 64 for sealing engagement with the inner liner 22 when the closure 16 is in a closed position as illustrated in FIGS. 7 and 8.

The base 134 is closed by an upper section 140 to define an insulation receiving volume 142. In addition, a sleeve 144 is located within the insulation receiving space 142 as part of the base section 134 and extends to an upper opening 144 in the top 140. The rigid straw 42 is fixed within the sleeve 144 and the lower end, shown at 44 is a lance-like end. The upper end 46 extends above the top 140 and removably receives the mouthpiece 50 which in turn may receive the cap 52. A groove 66 surrounds the point of opening of the sleeve 144 in the base section 134 and mounts an O-ring seal 68.

In use, the closure 16 is placed within the upper opening 28 and a beverage bag 20 introduced into the beverage bag receiving space 18 without being pierced by the piecing end 44 of the rigid straw 42. This is as shown in FIG. 7. The bottom 10 may then be threaded in place to close the lower opening 124 which will cause the beverage bag to be impaled by the lance-like end 44 so that upon removal the cap 52, the contents thereof may be sipped by the user of the device. Again, it will appreciated that the interior, i.e., the bag receiving space 18, is sealed by the O-ring seals 64,68 and 126 to eliminate leakage.

From the foregoing, it will be appreciated that an insulated container for a beverage bag provides a means of maintaining the contents of the beverage bag at a desired serving temperature for a prolonged period. Consequently, consumption of the beverage within the beverage bag 20 will be more pleasurable since it will be at the desired serving temperature for a longer period of time because it cannot be warmed or cooled by the ambient.

In addition, difficulties with leakage at the point of entry of the straw 42 into the beverage bag 20 is minimized or eliminated altogether by the presence of the seal 68 as well as the seal carried by the closure 16 and the bottom 10 certain of the embodiments.

What is claimed is:

1. An insulating container for a beverage bag, comprising:

an insulated container including a bottom wall, an upstanding, insulated side wall defining a beverage bag receiving space having an upper opening and a closure movable between positions opening and closing said upper opening;

a rigid straw mounted on an said insulated container and having opposed ends, one of said ends having a sharp, lance-like tip located within said beverage bag receiving space in spaced relation to said walls for piercing and entering a beverage bag located within said beverage bag receiving space and the other of said ends extending away from said insulating container;

a straw-like mouthpiece disposed on said other end in telescoping relation thereon; and a seal disposed about said one end for sealing engagement with both said one end and a beverage bag located within said beverage bag receiving space when said one end has pierced and entered a beverage bag with said beverage bag receiving space.

2. The insulating container of claim 1 wherein said rigid straw is mounted on said closure.

3. The insulating container of claim 2 wherein said closure includes first and second cup-like structures opening toward each other with the second cup-like structure being movably and telescopingly received within said first cup-like structure, cooperating retention elements on said side wall near said upper opening and on said first cup-like structure removably retaining said closure with said first cup-like structure in and closing said upper opening, and a sleeve in and extending through said first cup-like structure slidably receiving said rigid straw one end, said rigid straw other end extending through and being attached to said second cup-like structure.

4. The insulating container of claim 3 further including a compression coil spring located between said cup-like structures.

5. The insulating container of claim 3 wherein said seal is a ring located on said first cup-like structure to surround and seal against said rigid straw one end when said rigid straw one end extends from said sleeve into said beverage bag receiving space.

6. The insulating container of claim 5 wherein said seal is an O-ring.

7. The insulating container of claim 3 further including a seal carried by said first cup-like structure about its periphery and in sealing engagement with an interior part of said side wall when said closure is in a position closing said upper opening.

8. The insulating container of claim 1 wherein said side wall and said bottom wall are integral with one another.

9. The insulating container of claim 8 wherein said bottom wall and said side wall both include inner and outer walls defining an insulating space.

10. The insulating container of claim 1 wherein said rigid straw is in two sections, one carried by said side wall and/or said bottom and the other carried by said closure, said sections having aligned openings in fluid communication with each other when said closure is in a position closing said upper opening.

11. The insulating container of claim 10 further including a gasket carried by said insulated container and located at said aligned openings of said two sections.

12. The insulating container of claim 10 wherein said closure includes a pivotal connection to said side wall adjacent said upper opening.

13. The insulating container of claim 12 further including a closure lock opposite said pivotal connection for locking said closure in a position closing said upper opening.

14. The insulating container of claim 1 further including a seal carrier slidably receiving on said rigid straw one end and carrying said seal on a side of said carrier, and a biasing spring bearing against said seal carrier oppositely of said seal.

15. The insulating container of claim 14 wherein said one end extends into said beverage bag receiving space from said bottom wall and said spring is interposed between said seal carrier and said bottom wall.

16. The insulating container of claim 1 wherein said rigid straw is in two sections, one carried by said side wall and/or said bottom and the other carried by said closure, said sections having aligned openings in fluid communication with each other when said closure is in a position closing said upper opening, said one section being generally L-shaped and partly located in said side and partly in said bottom wall such that said one end extends upwardly into said beverage bag receiving space from said bottom wall.

17. The insulating container of claim 16 further including a closure lock opposite said pivotal connection for locking said closure in a position closing said upper opening.

18. The insulating container of claim 1 wherein at least said side wall includes an inner shell and an outer shell defining an insulating space.

19. The insulating container of claim 1 wherein said closure includes a sleeve in which said rigid straw is received with said one end directed toward said beverage bag receiving space.

20. The insulating container of claim 19 further including a seal at an interface of said sleeve and said rigid straw and within said beverage bag receiving space.

21. The insulating container of claim 1 wherein said bottom, said side wall and said closure are separable from one another.

22. The insulating container of claim 21 wherein both said bottom and said closure are plug-like and carry respective seals, each engaging an adjacent part of said side wall.

23. The insulating container of claim 1 further including a removable cap for said mouthpiece.

* * * * *